United States Patent [19]

Mulder et al.

[11] Patent Number: 4,539,508

[45] Date of Patent: Sep. 3, 1985

[54] METHOD OF PRODUCING A LOW-PRESSURE MERCURY VAPOR DISCHARGE LAMP

[75] Inventors: Berend J. Mulder; Sybrandus van Heusden, both of Eindhoven, Netherlands

[73] Assignee: U.S. Philips Corporation, New York, N.Y.

[21] Appl. No.: 441,186

[22] Filed: Nov. 12, 1982

[30] Foreign Application Priority Data

Dec. 4, 1981 [NL] Netherlands ..... 8105464

[51] Int. Cl.[3] ..... H01J 61/28

[52] U.S. Cl. ..... 313/546; 313/550; 445/9; 445/18

[58] Field of Search ..... 313/546, 565, 566, 492, 313/490, 550; 445/9, 18, 31, 40, 41, 55, 57

[56] References Cited

U.S. PATENT DOCUMENTS 2,283,189 5/1942 Cox ..... 313/546

3,657,589 4/1972 Della Porta et al. ..... 313/490

4,427,919 1/1984 Grenfell ..... 313/546

FOREIGN PATENT DOCUMENTS 27059 6/1976 Japan ..... 313/490

131369 10/1979 Japan ..... 445/9

*Primary Examiner*—David K. Moore

*Attorney, Agent, or Firm*—Robert S. Smith

[57] ABSTRACT

A method of producing a low-pressure mercury vapor discharge lamp which includes positioning a container in the lamp vessel of the lamp between the electrodes. The container holds a quantity of mercury required for operation of the lamp and is attached to a supporting element (wire). The supporting element is connected to a lead-in wire of a first electrode by a metal connecting wire. A direct current discharge is generated between the container and the second electrode, the mercury escapes from the container, thereafter the connection between the supporting element and the lead-in wire is interrupted.

7 Claims, 2 Drawing Figures

METHOD OF PRODUCING A LOW-PRESSURE MERCURY VAPOR DISCHARGE LAMP

The invention relates to a method of producing a low-pressure mercury vapor discharge lamp, use being made of a lamp vessel in which at least two electrodes are arranged, the quantity of mercury required for operation of the lamp being held in a metal container provided in a position in the lamp vessel between the electrodes, mercury being released from this container by heating after evacuation of the lamp. The invention further relates to lamps produced in accordance with such a method.

Such a method is disclosed in the U.S. Pat. No. 2,283,189.

In the method described in said patent application a closed metal container containing mercury is provided in the lamp vessel and attached to one of the electrode lead-in wires. After substantially all the manufacturing steps relating to the evacuation process, such as, for example, degassing the walls and other lamp components, annealing and degassing of the electrodes, the provision of a rare gas, etc., have been completed the container is heated. Heating is effected, in accordance with said patent specification, by means of radiation from the adjacent electrode. The container is opened by the mercury vapor pressure building up in the container as a result of said radiation, and the mercury escapes into the lamp atmosphere. The container is so arranged relative to the adjacent electrode that it also serves to facilitate starting of the lamp.

This prior art method has the disadvantage that the container must be provided very close to the electrode in order to profit to a sufficient extent from the heat radiated by the electrode. Attaching the comparatively heavy container to a lead-in wire of the electrode is a time-consuming procedure. Moreover, the position of the container relative to the electrode is not always exactly the same in different lamps of one batch. As a result thereof rather large mutual differences occur in the instants at which the mercury is formed and the rate at which the merury escapes into the lamp atmosphere.

The invention has for its object to provide a method of producing a low-pressure mercury vapor discharge lamp in which the quantity of mercury required for the operation of the lamp can be dosed in an accurate, fast and reproduceable manner.

According to the invention, the method of producing a low-pressure mercury vapor discharge lamp is characterized in that the container is attached to a metal supporting element which is connected to one of the electrode lead-in wires of a first electrode by means of a metal connecting wire, a direct current discharge being temporarily generated between the container and a second electrode, whereby the container is heated and mercury is released from the container, whereafter the connection between the supporting element and the electrode lead-in wire is interrupted.

In the method in accordance with the invention the mercury is positioned in the lamp vessel in a fast, accurate and reliable manner. The method is very suitable for use in mass-production as no special measures are required for positioning the container with mercury in the correct position in the lamp vessel. As the dimensions of the container are very small in a practical embodiment, the quantity of energy required to open the container is small.

Between the container (which preferably serves as an anode) and the second electrode (cathode) a direct current discharge is maintained for a short period of time. The container is heated by an electron bombardment and the mercury is released from the container. Heating is effected faster according as the dimensions of the container are smaller and the current intensity is higher. The current supply for the direct discharge proceeds via one of the lead-in wires of the first electrode and the metal supporting element which is connected to the said lead-in wire by means of a metal wire. This metal connecting wire is interrupted by melting by means of, for example, a short current pulse of a sufficient intensity after the mercury has been introduced in the lamp vessel. No additional auxiliary means are required.

In an embodiment of the method the container is preferably positioned in the region of the first electrode. The metal supporting element (which is, for example, in the form of a metal wire or pin) is attached to, for example, the lamp foot. The supporting element can then be provided in a comparatively simple way as said feet are often produced separately from the further lamp components.

The container may consist of, for example, a closed metal can, containing metallic mercury. Preferably, the metal container is in the form of a support for a mercury alloy. An example is a thin-walled, plate-shaped metal container to which a suitable mercury alloy is attached in the form of a pill, the mercury having such a composition that it can withstand comparatively high temperatures (approximately 500° C.) produced during the manufacturing procedure. The pill consists, for example, of an alloy of mercury with titanium and/or zirconium. Good results were obtained with a pill containing $Ti_3Hg$. The advantage of a container with such a pill is that the mercury is not released until at a comparatively high temperature, which prevents unwanted residual gasses from being introduced into the lamp vessel. In addition, in this embodiment of the method mercury can be dosed in small quantities. This is particularly advantageous in the production of lamps having a small discharge vessel, such as compact low-pressure mercury vapor discharge lamps, which are used as an alternative to incandescent lamps for general lighting purposes.

The release of the mercury can be effected wholly separately from the further lamp treatments. Optionally, lamp vessels may be marketed which are closed in a vacuumtight manner but which still comprise a container from which the mercury must still be released. This may then be done at a later, suitable moment, for example by the buyer of these "lamps". The operation is then, namely, so simple (the buyer only needs to apply a d.c. voltage for a short period of time) that he can perform this himself. All this has the advantage that should the "lamps" break during transportation no mercury vapour can escape into the environment. Consequently, the invention also relates to lamp vessels of said type.

The invention will now be further described by way of example with reference to the acompanying drawing, wherein.

Figure 1:
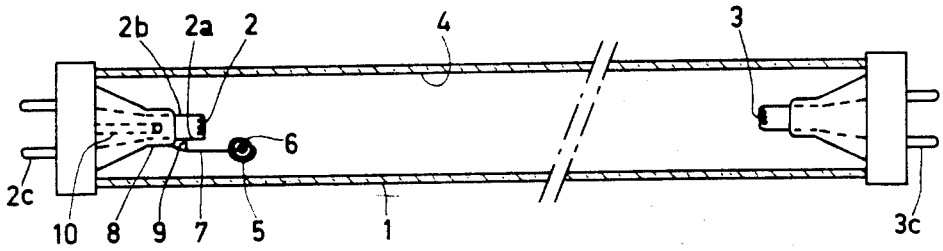
FIG. 1 shows a cross-sectional view through a tubular lamp vessel of a low-pressure mercury vapor discharge lamp in which lamp vessel a dosed quantity of mercury is applied by means of a method in accordance with the invention.

In FIG. 1 reference numeral 1 denotes the wall of a tubular lamp vessel of a low-pressure mercury vapor discharge lamp, two electrodes (2 and 3, respectively) being arranged in this lamp vessel. The interior wall of the lamp vessel is provided with a luminescent layer 4 consisting of a mixture of two phosphors, namely trivalent europium-activated yttrium oxide and trivalent terbium-activated cerium-magnesium aluminate. The lamp vessel further comprises a metal container 5 in which an alloy of $Ti_3Hg$ is present, in the form of a pill 6. The container consists of a metal plate (titanium), having a number of arms by means of which the pill is kept in place. The container 5 is connected to a metal supporting element 7. This supporting element is in the form of a metal wire (for example consisting of tantalum), fastened in the pinch 8 of the foot assembly.

The supporting element 7 is connected to one of the electrode lead-in wires 2*a*, 2*b* by means of a nickel connecting wire 9 (for example by spot welding).

Figure 2:
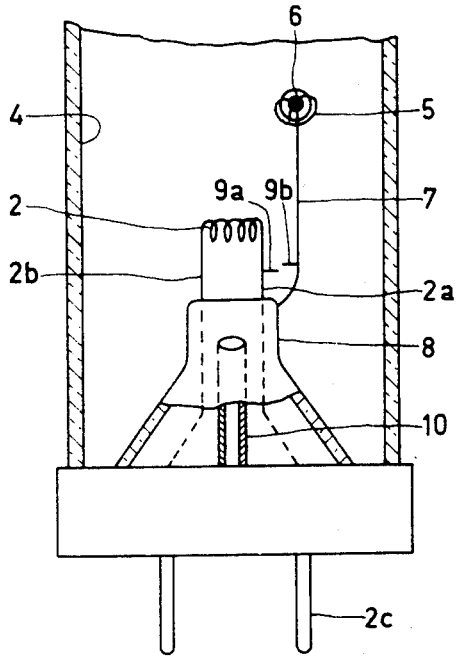
FIG. 2 shows, partly in cross-section, one and of a lamp vessel of a low-pressure mercury vapor discharge lamp produced by means of a method in acordance with the invention.

In the production of the lamp the starting point is a tubular lamp vessel the interior wall of which is provided in known manner with the luminescent layer. Thereafter the lamp foot assemblies are attached in a vacuum-tight manner to the ends of the lamp vessel. These foot assemblies comprise electrodes, the supporting element with container, lead-in wires, and exhaust tube, etc. Thereafter the lamp vessel is evacuated (via the exhaust tube 10), the rare gas atmosphere is provided and the lamp vessel is closed in a vacuum-tight manner by sealing the exhaust tube 10. Thereafter mercury is released from the $Ti_3Hg$ alloy (6) in the container 5 by generating a direct currnt discharge between the container 5 and electrode 3. The container 5 functions as the anode, the electrode 3 as the cathode. This mercury release is effected by connecting pin 2*c*, which is connected to the electrode lead-in wire 2*a* and the connecting pin 3*c*, which is connected to electrode 3, to a d.c. voltage supply. Preferably, during this procedure electrode 3 (the cathode) is heated to an adequate operating temperature by means of an a.c. voltage. As a result of the direct current discharge the container 5 is heated and a quantity of mercury is released from the alloy $Ti_3Hg$ (the mercury dispenser). Using a pill containing approximately 5 mg $Ti_3Hg$ (corresponding to approximately 0.3 mg of mercury), having a diameter of approximately 3 mm, a height of approximately 0.3 mm, 90% of the mercury escaped from the pill within 5 seconds at a current intensity of the direct current discharge of approximately 500 mA. Thereafter the nickel wire 9 (diameter approximately 60 $\mu$) was broken by means of melting by applying a short current pulse (700 mA; 0.1 sec.). The lamp is then ready for use. In FIG. 2 the portions of the interrupted melting wire are denoted by 9*a* and 9*b*.

What is claimed is

1. A method of producing a low-pressure mercury vapor discharge lamp:
   providing a lamp vessel in which at least two electrodes are arranged;
   providing the quantity of mercury required for operation of the lamp in a metal container disposed in a position in the lamp vessel between the electrodes;
   attaching the container to a metal supporting element;
   connecting the metal supporting element to one of the electrode lead-in wires of a first electrode by means of a metal connecting wire;
   releasing mercury from the container by heating after evacuation of the lamp, said heating step being accomplished by a direct current discharge being temporarily generated between the container and a second electrode, whereby the container is heated and mercury is released from the container, whereafter the connection between the supporting element and the electrode lead-in wire is interrupted.

2. A method as claimed in claim 1, wherein the connection between the supporting element and the electrode lead-in wire is in the form of a wire which is melted by means of a current pulse.

3. A method as claimed in claim 1, wherein the container is positioned in the region of the first electrode.

4. A method as claimed in claim 1, wherein the container is in the form of a support to which a pill containing mercury alloy is attached.

5. A method as claimed in claim 4, wherein the alloy contains $Ti_3Hg$.

6. A low-pressure mercury vapor discharge lamp produced by means of a method as claimed in claim 1.

7. A low-pressure mercury vapor discharge lamp comprising a lamp vessel having at least two electrodes therein, a metal container provided in the lamp vessel between the electrodes and holding a quantity of mercury required for operation of the lamp, a metal supporting element which supports the container in said position, and a fusible metal connecting wire which connects the supporting element to one of the lead-in wires of a first of said electrodes, said metal supporting element being attached to a wall portion of said lamp vessel which is electrically insulated from the electrode lead-in wires, the mercury being releasable from the container by establishing, via the fusible wire, a direct current electrical discharge between the container and a second said electrode, and the fusible wire is fused by establishing such a discharge having a higher discharge current that that required to release the mercury.

* * * * *